US009725950B2

(12) United States Patent
Delano

(10) Patent No.: US 9,725,950 B2
(45) Date of Patent: Aug. 8, 2017

(54) LIGHT BLOCK HEM SEAL AND METHOD OF MANUFACTURE

(71) Applicant: Crestron Electronics, Inc., Rockleigh, NJ (US)

(72) Inventor: Calvin Delano, Pompton Lakes, NJ (US)

(73) Assignee: CRESTRON ELECTRONICS, INC., Rockleigh, NJ (US)

( * ) Notice: Subject to any disclaimer, the term of this patent is extended or adjusted under 35 U.S.C. 154(b) by 0 days.

(21) Appl. No.: 14/927,030

(22) Filed: Oct. 29, 2015

(65) Prior Publication Data

US 2017/0122029 A1 May 4, 2017

(51) Int. Cl.
*E06B 9/58* (2006.01)
*E06B 9/42* (2006.01)
*E06B 9/24* (2006.01)

(52) U.S. Cl.
CPC ..... *E06B 9/582* (2013.01); *E06B 9/42* (2013.01); *E06B 2009/2417* (2013.01)

(58) Field of Classification Search
CPC ..... E06B 9/40; E06B 9/42; E06B 9/17; A47H 23/01
USPC ..... 112/423, 424, 427, 63, 141, 147, 475.06
See application file for complete search history.

(56) References Cited

U.S. PATENT DOCUMENTS 1,184,208 A 5/1916 Peter
2,138,633 A * 11/1938 Blum ..... D05B 35/02 112/141
2,241,352 A * 5/1941 Johnson ..... E06B 9/42 160/384
2,318,565 A * 5/1943 Snyder ..... E06B 9/44 112/423
2,354,489 A 7/1944 Tucker
2,638,157 A * 5/1953 Cook ..... A47C 27/003 112/423
2,713,685 A * 7/1955 Nachem ..... A41D 1/06 112/424
3,882,921 A 5/1975 Sandall
4,357,978 A 11/1982 Keller et al.
4,499,937 A * 2/1985 Waine ..... E06B 9/17046 160/271

(Continued)

OTHER PUBLICATIONS

Alumaline Welded Pocket, published 2013, accessed Jan. 3, 2017 from www.alumalineaz.com/roller-shades-page4.html.*

(Continued)

*Primary Examiner* — Katherine Mitchell
*Assistant Examiner* — Jeremy Ramsey
(74) *Attorney, Agent, or Firm* — Crestron Electronics, Inc

(57) ABSTRACT

A shade for covering a window, a door, or a wall opening is provided comprising a shade material forming a shade portion and an integral hem bar assembly constructed by folding a bottom portion of the shade material. The hem bar assembly comprises an outer laterally extending pocket that envelopes an inner laterally extending pocket. Upon meeting a horizontal surface, the outer pocket of the hem bar assembly deflects and conforms to the horizontal surface to eliminate any light gap between the hem bar assembly and the horizontal surface without causing the shade portion of the shade material to buckle or ripple. The hem bar assembly is constructed such that no excess material, edges, or ends appear on the front surface of the shade material.

20 Claims, 10 Drawing Sheets

(56) References Cited

U.S. PATENT DOCUMENTS

| | | | | |
|---|---|---|---|---|
| 4,516,618 | A | 5/1985 | Gardner et al. | |
| 4,597,430 | A | 7/1986 | Marquez | |
| 4,865,109 | A | 9/1989 | Sherman | |
| 5,205,333 | A * | 4/1993 | Judkins | E06B 9/262 160/84.02 |
| 5,443,563 | A * | 8/1995 | Hindel | E06B 9/40 160/238 |
| 6,655,440 | B2 | 12/2003 | Brunk | |
| 2010/0236725 | A1 * | 9/2010 | Kraeutler | E06B 9/80 160/1 |

OTHER PUBLICATIONS

Draper, Inc., LightBloc Manual FlexShade®, www.draperinc.com/WindowShades/ProductDetail.aspx?detail=14.

Fraser Shading Systems Inc., Light Seal Hembar Channels, www.frasershading.com/fsswebsite_049.htm.

MechoSystems, Room Darkening, www.mechoshade.com/roomdarkening/light_seal_hembar.cfm.

MechoSystems, Room-Darkening Systems the Complete Program, 2014, available at www.mechosystems.com/literature/L10021_Room_Darkening.pdf.

Windowtex, External Hembar, www.windowtex.com/external-hembar.html.

* cited by examiner

LIGHT BLOCK HEM SEAL AND METHOD OF MANUFACTURE

BACKGROUND OF THE INVENTION

Technical Field

Aspects of the embodiments relate to shades, and more particularly to systems, methods, and modes for a roller shade having a hem bar assembly that absorbs the light gap created between the bottom of the shade material and a horizontal surface, such as a sill, without any additional hardware or changes in the appearance of the roller shade.

Background Art

Roller shades are effective in screening windows, doors, or the like, to achieve privacy and thermal effects. A roller shade typically includes a rectangular shade material attached at its top end to a cylindrical rotating tube, called a roller tube, and at an opposite bottom end to a hem bar assembly. The shade material is wrapped around the roller tube. The roller tube is rotated, either manually or via an electric motor, to unravel the shade material to cover a window.

When the roller shade material is lowered to cover the window, the bottom of the shade contacts a horizontal surface, such as the floor or a window sill. Often, however, the floor or the sill surface is uneven or unleveled. As a result, the shade can only be lowered to a point where the bottom of the shade makes contact with the highest point of the uneven surface. This creates a light gap, or a light bleed, at any point at which the shade does not contact the uneven surface. If the shade is lowered beyond the point of first contact, the shade's fabric will buckle and create unseemly folds or ripples where excess fabric is present.

Certain applications require a blackout shade that provides advanced light blockage and privacy, such as in bedrooms and media rooms. Current blackout roller shades use additional accessories to create a complete blackout by eliminating the light gap between the shade material and the floor or the sill. One such solution includes an L-shaped bracket attached to the uneven surface of the floor or the sill creating a lip behind which the shade material can be lowered in order to mask the uneven light gap. Another solution includes a first longitudinal hooked portion attached to the sill that hooks to a second longitudinal hooked portion attached to the bottom of the shade material to mask the light gap. Another method provides a channel affixed to the bottom of the shade material that includes a separate liner material, such as a weather strip, which conforms to the uneven surface of the sill and masks the light gap. The aforementioned solutions, however, create additional cost and add hardware that can be unsightly, detract from the clean look of the installed product, and which may mar the surface of the window sill.

Accordingly, a need has arisen for a hem bar assembly that absorbs the light gap created between the bottom of the shade material and a horizontal surface, such as a sill, without any additional hardware or changes in the appearance of the roller shade.

SUMMARY OF THE INVENTION

It is an object of the embodiments to substantially solve at least the problems and/or disadvantages discussed above, and to provide at least one or more of the advantages described below.

It is therefore a general aspect of the embodiments to provide systems, methods, and modes for a shade with a hem bar assembly that will obviate or minimize problems of the type previously described.

More particularly, the aspects of the embodiments provide systems, methods, and modes for a roller shade with a hem bar assembly that absorbs the light gap created between the bottom of the shade material and a horizontal surface, such as a sill, without any additional hardware or changes in the appearance of the roller shade.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

DISCLOSURE OF INVENTION

According to one aspect of the embodiments, a shade is provided for covering a window, a door, or a wall opening comprising a shade material forming a shade portion and a hem bar assembly. The hem bar assembly comprises an inner laterally extending pocket and an outer laterally extending pocket. The inner laterally extending pocket comprises a first layer connected to a second layer via a first fold. The outer laterally extending pocket encloses the inner pocket and is connected to the inner pocket via a second fold. The outer pocket comprises a third layer connected to a fourth layer via a third fold. The fourth layer extends down from and coextensive with the shade portion forming a smooth, uninterrupted, and continuous front surface. The second layer of the inner pocket can be connected to the third layer of the outer pocket via the second fold.

According to some aspects of the embodiments, the hem bar assembly is integral with the shade material and is constructed by folding a bottom portion of the shade material. The first, second, third, and fourth layers are secured to each other at their top ends via a seam, heat welding, stitching, adhesive, a thermoplastic layer, a thermoplastic film or a strip, or any combinations thereof. According to one embodiment, a bottom terminal end of the shade material is secured between a top end of the second layer and a top end of the third layer. According to another embodiment, a bottom terminal end of the shade material is secured between a top end of the second layer and a top end of the fourth layer. The first, second, and third layers, and the first fold, and the second fold are hidden from a front view of the shade. The inner pocket includes an opening that receives and conceals a weighted longitudinally and laterally extending bar.

According to some aspects of the embodiments, the shade is a roller shade and the shade material is connected at its top end to a roller tube and comprises the hem bar assembly at its bottom end. The shade portion wraps around the roller tube. The shade is rolled down from a rolled up position, when the shade portion is fully wrapped about the roller tube, to a rolled down position, when the shade portion is fully unraveled.

When the shade is in a closed position, a bottom end of the hem bar assembly contacts a horizontal surface and the outer pocket deflects and conforms to the horizontal surface to eliminate a gap between the hem bar assembly and the horizontal surface. Specifically, when the shade is in a closed position, a bottom end of the outer pocket contacts the horizontal surface and a bottom end of the inner pocket is positioned at a distance above the bottom end of the outer pocket. According to an embodiment, the inner pocket contains a weighted bar and when the shade is in a closed position the weighted bar hangs above the horizontal surface and pulls down on the shade portion such that it hangs straight, without causing the shade portion of the shade material to buckle or ripple.

According to another aspect of the embodiments, a shade is provided for covering a window, a door, or a wall opening, comprising a shade material forming a shade portion and a hem bar assembly. The hem bar assembly comprises (i) an inner laterally extending pocket comprising a first layer connected to a second layer via a first fold; and (ii) an outer laterally extending pocket enclosing the inner pocket and connected to the inner pocket via a second fold, the outer pocket comprises a third layer connected to a fourth layer via a third fold, the fourth layer extends down from and coextensive with the shade portion forming a smooth, uninterrupted, and continuous front surface. The first, second, and third layers, and the second fold are hidden from a front view of the shade. A bottom terminal end of the shade material is secured between a top end of the second layer and a top end of the third layer or the fourth layer. When the shade is in a closed position, a bottom end of the outer pocket contacts the horizontal surface causing the outer pocket to deflect, while a bottom end of the inner pocket is positioned at a distance above the bottom end of the outer pocket.

According to another aspect of the embodiments, a method is provided for manufacturing a hem bar assembly comprising an outer pocket enclosing an inner pocket made from a shade material of a shade for covering a window, a door, or a wall opening. The method comprises the steps of: (i) folding the shade material over its rear surface by bringing a terminal bottom end of the shade material up, over, and towards the rear surface, thereby forming the inner pocket comprising a first layer connected to a second layer by a first fold; (ii) folding the shade material over its rear surface by bringing the first fold up, towards, and over the rear surface, thereby forming a third layer connected to the second layer by a second fold; (iii) folding the shade material over its rear surface by bringing the second fold up, towards, and over the rear surface, forming the outer pocket comprising the third layer connected to a fourth layer via a third fold; and securing the first, second, third, and fourth layers to each other at their top ends proximal to the second fold. The layers can be secured to each other via a seam, heat welding, stitching, adhesive, a thermoplastic layer, a thermoplastic film or a strip, or any combinations thereof.

According to some aspect of the embodiments, the step of securing the layers comprises the steps of: (i) fusing the first layer and the second layer together in proximity to the terminal bottom end, thereby creating a first weld; (ii) fusing the third layer to the first layer and the second layer over the first weld, thereby creating a second weld; and (iii) fusing the fourth layer to the first layer, the second layer, and the third layer over the first weld and the second weld, thereby creating a third weld. In another embodiment, during the folding steps the shade material is laid flat with its decorative front surface faced down and its rear surface faced up.

According to another aspect of the embodiments, a method is provided for manufacturing a hem bar assembly comprising an outer pocket enclosing an inner pocket made from a shade material of a shade for covering a window, a door, or a wall opening. The inner pocket comprises a first layer connected to a second layer by a first fold. The inner pocket is connected to the outer pocket via a second fold. The outer pocket comprises a third layer connected to a fourth layer via a third fold. The method comprises the steps of: (i) folding the shade material over the rear surface by bringing a terminal bottom end of the shade material up, over, and towards the rear surface, thereby forming the second layer and the third layer connected by the second fold; (ii) folding the shade material over a front surface by bringing the terminal bottom end of the shade material up, over, and towards the second fold, thereby forming the inner pocket comprising the first layer connected to the second layer by the first fold; (iii) folding the shade material over the rear surface by bringing the second fold towards, and over the rear surface of the shade material, thereby forming the outer pocket comprising the third layer connected to the fourth layer by the third fold; and (iv) securing the first layer, the second layer, the third layer, and the fourth layer to each other at their top ends proximal to the second fold.

According to some aspect of the embodiments, the step of securing the layers comprises the steps of: (i) fusing the second layer and the third layer together in proximity to the second fold, thereby creating a first weld; and (ii) fusing the first layer to the second layer and the third layer over the first weld, thereby creating a second weld. According to additional aspect of the embodiments, the step of securing the layers further comprises the step of: (iii) fusing the fourth layer to the first layer, the second layer, and the third layer over the first weld and the second weld, thereby creating a third weld.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

BRIEF DESCRIPTION OF THE SEVERAL VIEWS OF THE DRAWING

Figure 1:
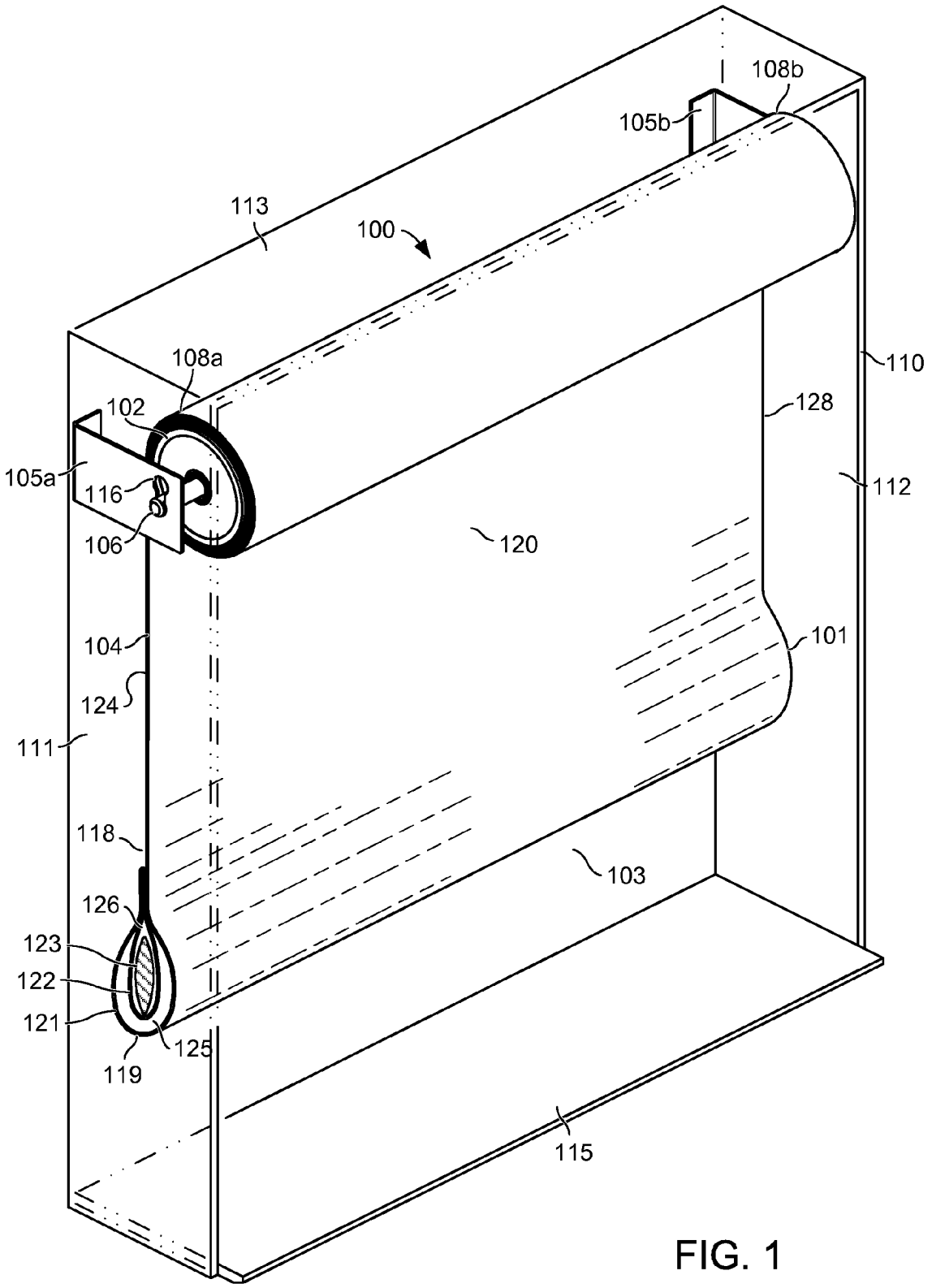
Figure 2:
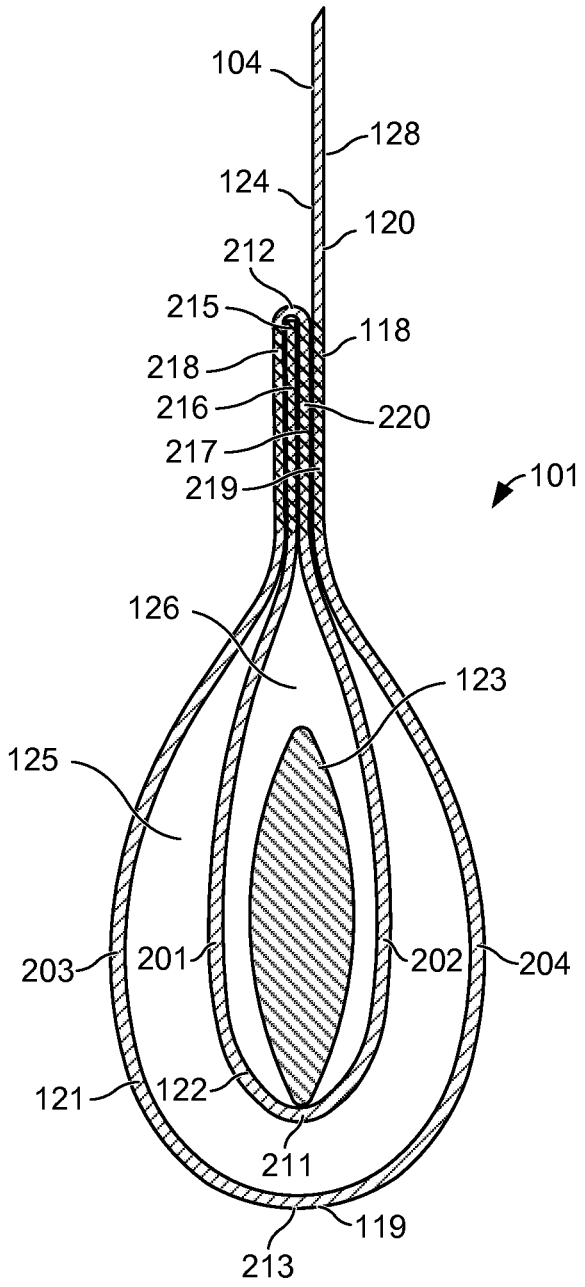
Figure 3:
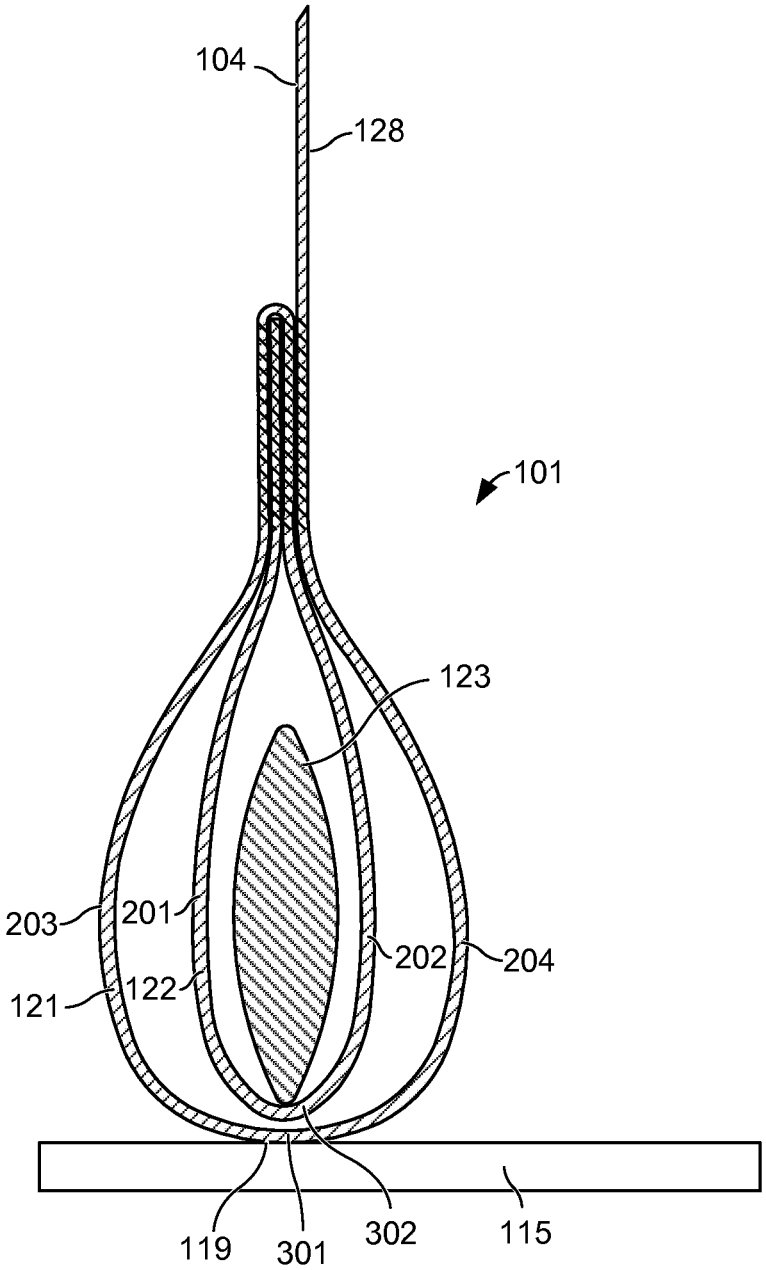
Figure 5:
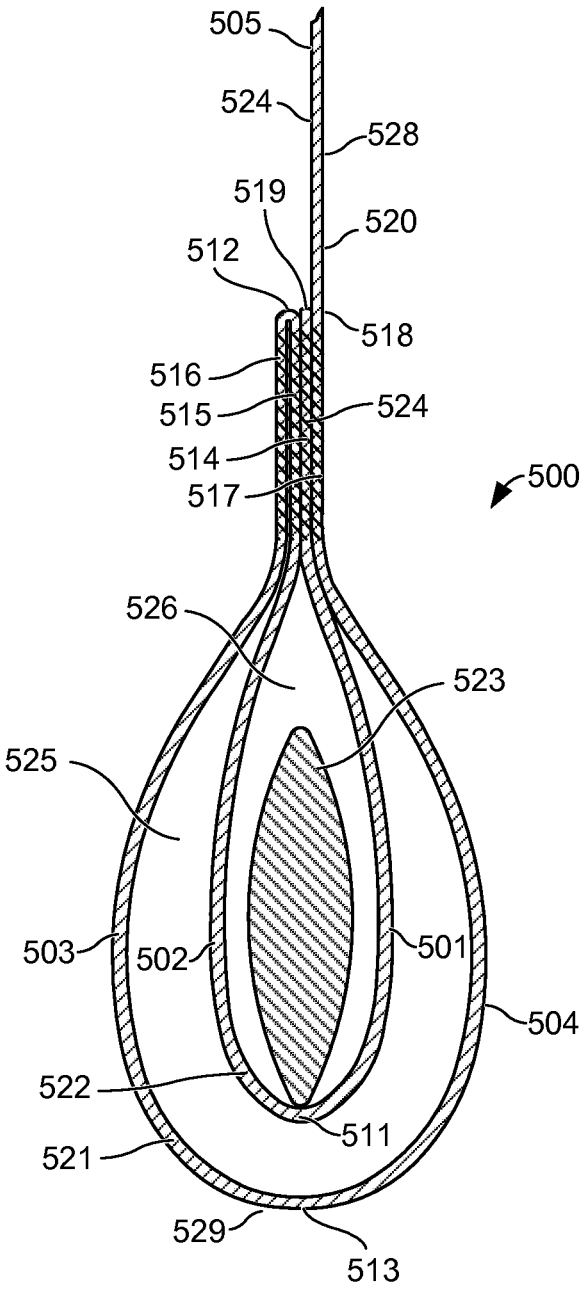

FIG. 1 illustrates a front perspective view of a roller shade comprising a hem bar assembly installed in a window according to one aspect of the embodiments;

FIG. 2 illustrates a side view of the hem bar assembly according to one aspect of the embodiments;

FIG. 3 illustrates a side view of the hem bar assembly in contact with a window sill according to one aspect of the embodiments;

FIGS. 4A-4F show the steps of an illustrative process of manufacturing a two-pocketed hem bar assembly according to one aspect of the embodiments;

FIG. 5 illustrates a side view of a hem bar assembly according to another aspect of the embodiments; and FIGS. 6A-6F show the steps of an illustrative process of manufacturing a two-pocketed hem bar assembly according to another aspect of the embodiments.

DETAILED DESCRIPTION OF THE INVENTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" on "in an embodiment" in various places throughout the specification is not necessarily referring to the same embodiment. Further, the particular feature, structures, or characteristics may be combined in any suitable manner in one or more embodiments.

LIST OF REFERENCE NUMBERS FOR THE ELEMENTS IN THE DRAWINGS IN NUMERICAL ORDER

The following is a list of the major elements in the drawings in numerical order.

100 Roller Shade
101 Hem bar assembly
102 Roller Tube
103 Window
104 Shade Material
105*a-b* Mounting Brackets
106 Gudgeon Pins
108*a* First End
108*b* Second End
110 Window Frame
111 First Side Jamb
112 Second Side Jamb
113 Head Jamb
115 Sill
116 Mounting Holes
118 Top End
119 Bottom End
120 Front Surface
121 Outer Pocket
122 Inner Pocket
123 Weighted Bar
124 Rear Surface
125 Space
126 Opening
128 Shade Portion
201 First Layer
202 Second Layer
203 Third Layer
204 Fourth Layer
211 First Fold
212 Second Fold
213 Third Fold
215 Terminal Bottom End
216 Top End
217 Top End
218 Top End
219 Top End
220 Seam
301 Bottom End
302 Bottom End
400 Welding Machine
401 Heating Strip
402 Sealing Strip
405 Flat Surface
410 Welding Feeder Assembly
411 First Weld
412 Second Weld
413 Third Weld
415 Direction
500 Hem Bar Assembly
501 First Layer
502 Second Layer
503 Third Layer
504 Fourth Layer
505 Shade Material
511 First Fold
512 Second Fold
513 Third Fold
514 Top End
515 Top End
516 Top End
517 Top End
518 Top End
519 Terminal Bottom End
520 Front Surface
521 Outer Pocket
522 Inner Pocket
523 Weighted Bar
524 Seam
525 Opening
526 Opening
528 Shade Portion
529 Bottom End
600 Heat Welding Machine
601 Heating Strip
602 Sealing Strip
605 Flat Surface
610 Welding Feeder Assembly
611 First Weld
612 Second Weld
613 Third Weld
615 Direction

MODE(S) FOR CARRYING OUT THE INVENTION

The different aspects of the embodiments described herein pertain to the context of roller shades, but are not limited thereto, except as may be set forth expressly in the appended claims. While the roller shade is described herein for covering a window, the roller shade may be used to cover doors, wall openings, or the like. The embodiments described herein may further be adapted in other types of window or door coverings, such as inverted rollers, Roman shades, Austrian shades, pleated shades, blinds, shutters, skylight shades, garage doors, or the like.

For 50 years Creston Electronics Inc., has been the world's leading manufacturer of advanced control and automation systems, innovating technology to simplify and enhance modern lifestyles and businesses. Crestron designs, manufactures, and offers for sale integrated solutions to control audio, video, computer, and environmental systems. In addition, the devices and systems offered by Crestron streamlines technology, improving the quality of life in commercial buildings, universities, hotels, hospitals, and homes, among other locations. Accordingly, the systems, methods, and modes of the aspects of the embodiments described herein, as embodied as 100, 101, and 500 can be manufactured by Crestron Electronics Inc., located in Rockleigh, N.J.

Referring to FIG. 1, there is shown a front perspective view of a roller shade 100 installed in a window 103 according to one embodiment. Roller shade 100 generally comprise a roller tube 102, shade material 104, and a hem bar assembly 101. Shade material 104 is connected at its top end to the roller tube 102 and comprises a shade portion 128 for covering the window 103. The bottom end of the shade material 104 comprises the hem bar assembly 101. Shade portion 128 wraps around the roller tube 102 and is unraveled from the roller tube 102 to cover the window 103. Roller tube 102 is generally cylindrical in shape and longitudinally and laterally extends from a first end 108*a* to a second end 108*b*. The roller tube 102 comprises gudgeon pins 106 at each of its ends 108*a* and 108*b* about which the roller tube 102 rotates. The roller shade 100 may be rolled down (closed) and rolled up (opened) via a motor, or manually or semi-manually by pulling or tugging on the hem bar assembly 101 or by pulling on a chain (not shown). In various embodiments, the shade material 104 comprises fabric, plastic, vinyl, or other materials known to those skilled in the art.

The roller shade 100 may be mounted within a window frame 110 comprising a first side jamb 111, a second side jamb 112, a head jamb 113, and a sill 115. The roller shade 100 is mounted between a first side jamb 111 and a second side jamb 112 in the proximity of the head jamb 113. A first mounting bracket 105*a* may be attached to the first side jamb 111 and a second mounting bracket 105*b* may be attached to the second side jamb 112. Gudgeon pins 106 attach to the mounting brackets 105*a* and 105*b* via mounting holes 116. The roller shade 100 is rolled down (closed) from a rolled up (opened) position, when the shade portion 128 is fully wrapped about the roller tube 102, to a rolled down (closed) position, when the shade portion 128 is fully unraveled. At the rolled down (closed) position, the bottom end 119 of the hem bar assembly 101 comes into contact with the window sill 115. In other embodiments, the roller shade 100 may be mounted on a wall, in front of the frame enclosing a window, a door, an opening, or the like, and its bottom end 119 may come into contact with other horizontal surfaces, such as the floor.

The hem bar assembly 101 utilizes a pocketed construction that absorbs any gap created by an uneven surface of the sill 115 without any additional hardware or changes in the appearance of the roller shade 100. A pocketed hem bar assembly construction is preferred by designers due to its clean and unobtrusive design. It does not add an additional architectural element to a partially drawn shade. The hem bar assembly 101 of the present embodiments is integral with the shade material 104 and is constructed by folding the bottom portion of the shade material 104, as discussed in greater detail below, to create at least two laterally extending pockets, including an outer pocket 121 and an inner pocket 122. The hem bar assembly 101 extends down from the shade portion 128 and comprises a top end 118 and a bottom end 119. The hem bar assembly 101 of the present embodiments is constructed such that no excess material, edges, or ends appear on the front surface 120 of the shade material 104. Only the decorative front surface 120 of the shade material 104 is visible from the front view of the roller shade 100. The layers of the shade material 104 forming the outer and inner pockets 121, 122 of the hem bar assembly 101 are disposed on the rear surface 124 and are hidden from the front view of the roller shade 100. Also, no folds, edges, or ends appear at the front view of the roller shade 100 at the top end 118 of the hem bar assembly 101. The front surface 120 of the shade material 104 extending across the shade portion 128 and the hem bar assembly 101 remains smooth and esthetically appealing.

The inner pocket 122 includes an opening 126 that receives and conceals a weighted bar 123. The weighted bar 123 runs longitudinally and laterally across the width of the shade 101 to minimize any movement in the field and allow for a straight hang of the shade portion 128 of the shade material 104. Weighted bar 123 can comprise a solid or a hollow construction. The weighted bar 123 may be secured to the inside surface of the inner pocket 122 via an adhesive, or the like. Inner pocket 122 is dimensioned to accommodate the required size of the weighted bar 123.

The outer pocket 121 is larger in size than the inner pocket 122 such that it envelops the inner pocket 122 creating an opening or space 125 therebetween. The additional space 125 created inside the outer pocket 121 and around the inner pocket 122 is used as a buffer to allow the roller shade 101 to be lowered onto sill 115 with an uneven surface. At the rolled down position, the bottom end 119 of the hem bar assembly 101 comes into contact with the window sill 115. Upon meeting the sill 115, the outer pocket 121 deflects and conforms to the uneven surface to eliminate any light gap between the hem bar assembly 101 and the sill 115 without causing the shade portion 128 of the shade material 104 to buckle or to show ripples.

The openings 125 and 126 of outer and inner pockets 121 and 122, respectively, may remain open at their ends during the use of the roller shade 100 to create an open pocket hem bar assembly. In another embodiment, end caps (not shown) may be supplied to provide a finished look to the ends of the hem bar assembly 101. In yet another embodiment, openings 125 and 126 may be sealed using a seam (e.g., heat welding, stitching, or the like) to create a sealed pocket hem bar assembly that encloses the weighted bar 123 therein.

FIG. 2 shows a side view of the hem bar assembly 101 illustrating the construction of the hem bar assembly 101 in greater detail. The inner pocket 122 is formed from a first layer 201 connected to a second layer 202 via a first fold 211 forming an opening 126 therein. The outer pocket 121 is connected to the inner pocket 122 via a second fold 212. The outer pocket 121 is formed from a third layer 203 connected to a fourth layer 204 via a third fold 213 forming an opening 125 therein. The second layer 202 of the inner pocket 122 is connected to the third layer 203 of the outer pocket 121 via the second fold 212.

The fourth layer 204 extends down from and coextensive with the shade portion 128 forming a smooth, uninterrupted, and continuous front surface 120. No folds, ends, or edges of the hem bar assembly 101 appear at the front view of the roller shade 100. Top ends 216, 217, 218, and 219 of layers 201, 202, 203, and 204 forming the outer and inner pockets 121 and 122, respectively, are secured to each other, at the top end 118 of the hem bar assembly 101, via a seam 220. In various embodiments, seam 220 is secured via heat welding, stitching, adhesive, or other binding materials known to those skilled in the art. The terminal bottom end 215 of the shade material 104, which is part of the first layer 201, is secured between the top end 217 of the second layer 202 and the top end 218 of the third layer 203. Accordingly, the terminal bottom end 215 of the shade material 104, which may be unfinished or frayed, is hidden from view and is prevented from fraying.

The weighted bar 123 is positioned inside the opening 126 of the inner pocket 122 between the first layer 201 and the second layer 202. The weighted bar 123 and the inner pocket 122 are in turn enveloped in the outer pocket 121 between the third layer 203 and the fourth layer 204. Space 125 is formed between the inner pocket 122 and the outer pocket 121.

FIG. 3 shows a side view of the hem bar assembly 101 illustrating the deflection of the outer pocket 121 when the bottom end 119 of the hem bar assembly 101 contacts a horizontal surface, such as a window sill 115. The roller shade 100 is rolled down or lowered until the bottom end 301 of the outer pocket 121 contacts the window sill 115, but before the bottom end 302 of the inner pocket 122 comes into contact with the bottom end 301 of the outer pocket 121. At this position, the third and fourth layers 203 and 204 of the outer pocket 121 are deflected outwardly as the bottom end 301 of the outer pocket 121 is pressed against the sill 115. The inner pocket 122 hangs down right above the window sill 115 such that the bottom end 302 of the inner pocket 122 is positioned at a distance above the bottom end 301 of the outer pocket 121. The first and second layers 201 and 202 of the inner pocket 122 are not deflected and the inner pocket 122 retains its form. As a result, the weighted bar 123 hangs above the horizontal surface 115 and continues to pull down on the shade portion 128 such that it continues to hang straight, without causing the shade portion 128 of the shade material 104 to buckle or to show ripples. The roller shade 100 can be preset to lower to this position during its installation.

The following section describes an illustrative process of manufacturing the two-pocketed hem bar assembly 101 of the present embodiments with reference to FIGS. 4A-4F, which illustrate the various steps of the manufacturing process. In one embodiment, the layers of the hem bar assembly 101 are fused together via heat welding using a heat welding machine, such as welding machine 400 shown in FIG. 4A. Welding machine 400 can comprise a flat surface 405 that supports the material to be welded. Flat surface 405 is aligned with a welding feeder assembly 410, which receives and welds the material. Welding feeder assembly 410 can comprise a heating strip 401 aligned with and disposed opposite to a sealing strip 402. The heating strip 401 and sealing strip 402 receive the shade material 104 and cooperate to grip the shade material 104 therebetween. Heat is applied to heating strip 401 that correspondingly heats the sealing strip 402 causing the shade material 104 to melt and thereby welding the shade material 104. In various embodiments, the shade material 104 can comprise fabric, plastic, vinyl, or other materials known to those skilled in the art. Shade material 104 made of a thermoplastic material, such as PVC, can be directly welded using the heat welding machine 400. Other types of shade material 104 can be welded by coating the surface of the shade material 104 with a thermoplastic layer or adhesive, or by adding a thermoplastic film or a strip between the layers to be welded. In other embodiment, the layers of the hem bar assembly 101 can be secured via other means known to those skilled in the art, including, but not limited to stitching and adhesive.

In one embodiment, prior to forming the two-pocketed construction, the shade material 104 is cut to a requisite size allowing additional length of material to accommodate the outer and inner pockets 121 and 122. In another embodiment, the shade material 104 is fed into the welding machine 400 from a roll of shade material, the two-pocketed construction is formed with the assistance of the welding machine 400, and then the shade material 104 is cut to a requisite size.

Figure 4A:
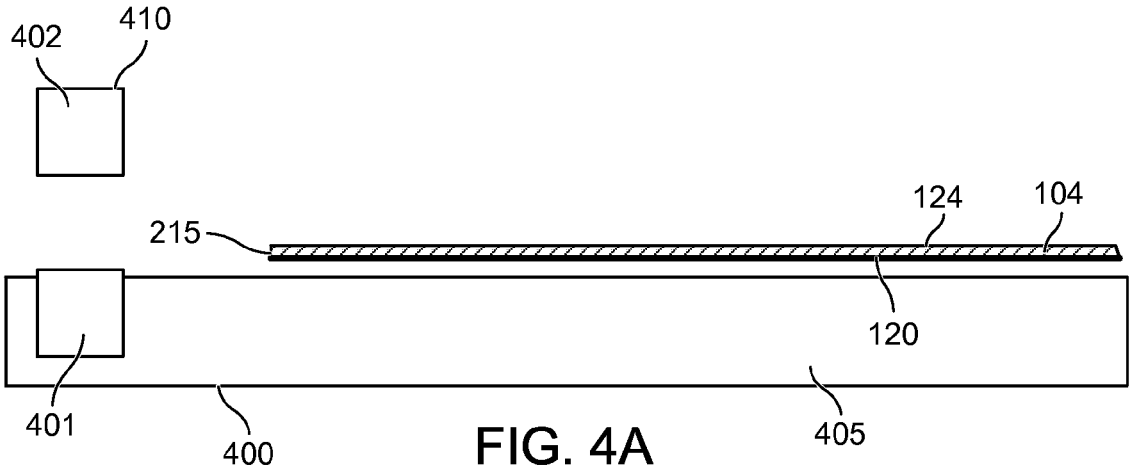
Figure 4B:
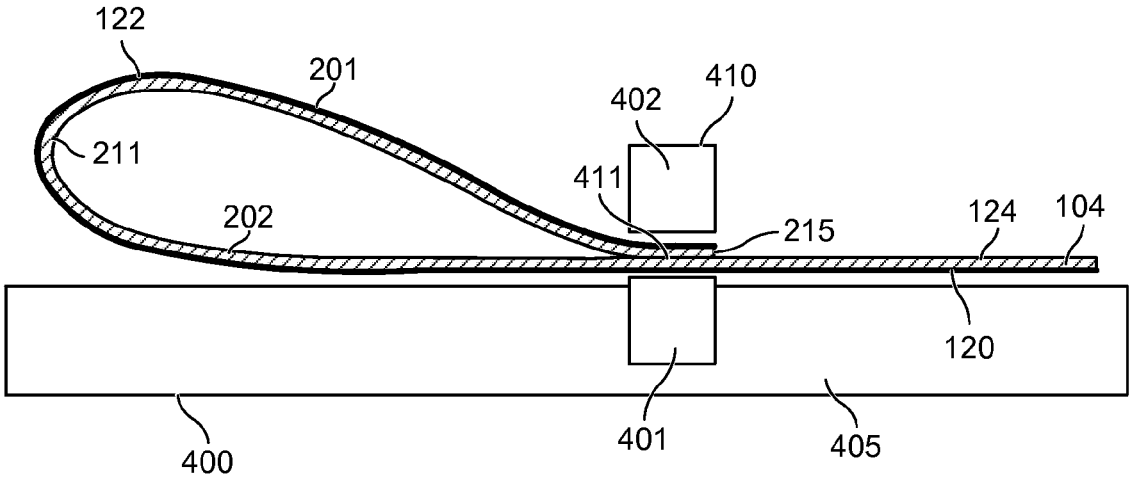

As shown in FIG. 4A, the shade material 104 is laid flat on the flat surface 405 of the welding machine 400. Shade material 104 is laid with its decorative front surface 120 faced down, the rear surface 124 faced up, and the terminal bottom end 215 facing the welding feeder assembly 410. As shown in FIG. 4B, the shade material 104 is then folded over the rear surface 124 (rear surface 124 to rear surface 124) by bringing the terminal bottom end 215 up, over, and towards the rear surface 124, forming the first layer 201 and the second layer 202 connected by the first fold 211. This forms an inner pocket 122 comprising a first layer 201 connected to a second layer 202 via the first fold 211. The shade material 104 can be folded manually or automatically via the welding machine 400 as is known in the art. Next, the first layer 201 and the second layer 202 are fused together in proximity to the terminal bottom end 215 via the heating strip 401 and the sealing strip 402, creating a first weld 411.

Figure 4C:
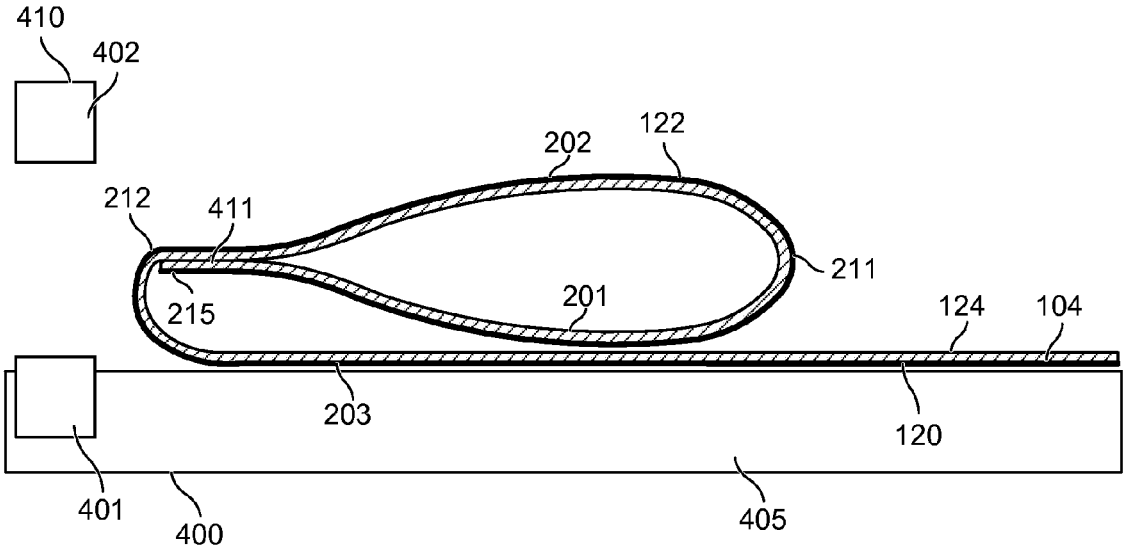
Figure 4D:
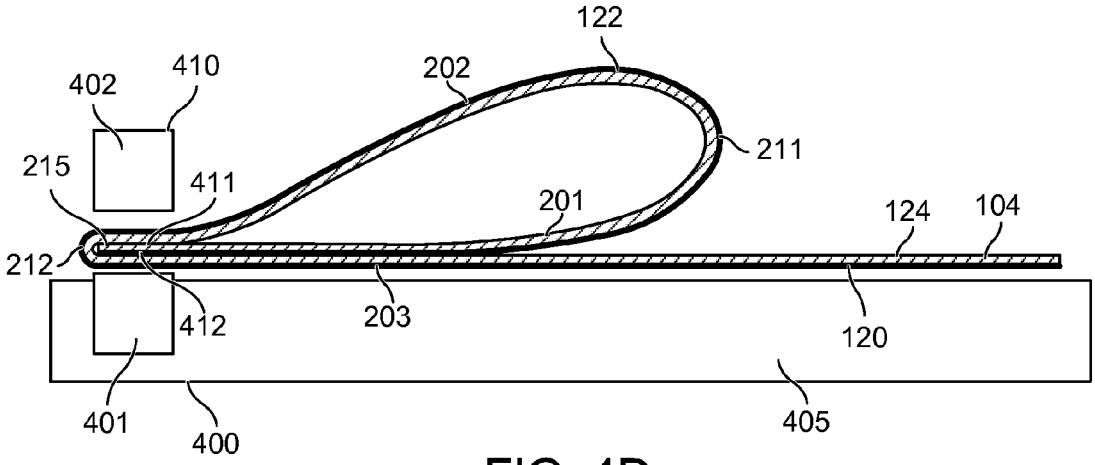

Referring to FIG. 4C, the shade material 104 is folded over the rear surface 124 by bringing the first fold 211 of the inner pocket 122 up, towards, and over the rear surface 124 of the shade material 104, forming a third layer 203 connected to the second layer 202 by a second fold 212. The second fold 212 is created in proximity to the first weld 411. As shown in FIG. 4D, the third layer 203 is fused to the first layer 201 and the second layer 202 in proximity to the second fold 212 and over the first weld 411, creating a second weld 412.

Figure 4E:
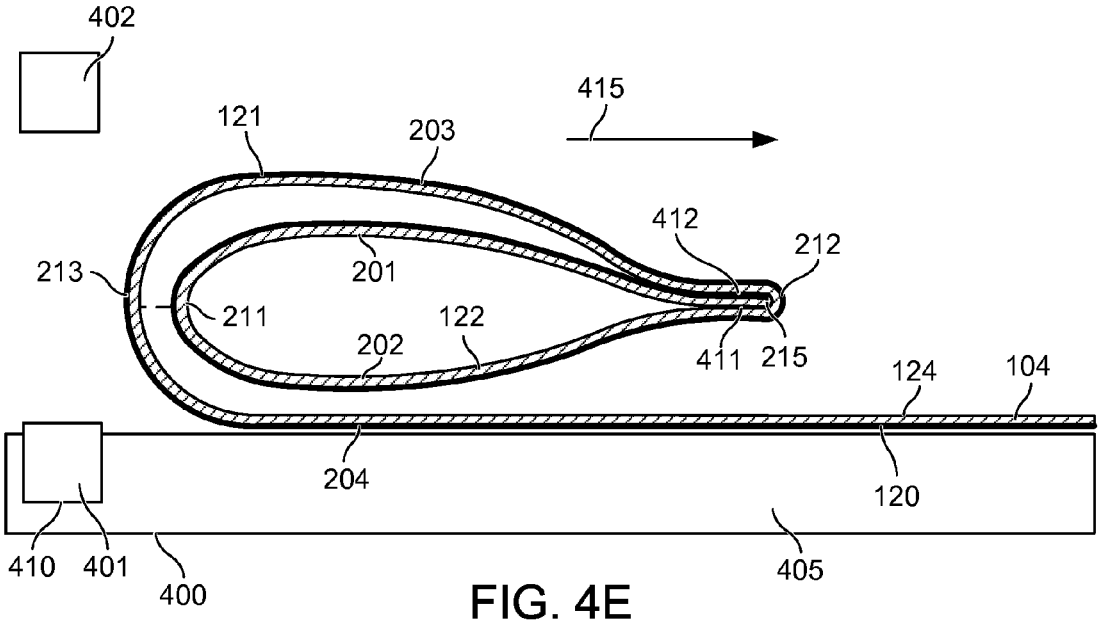
Figure 4F:
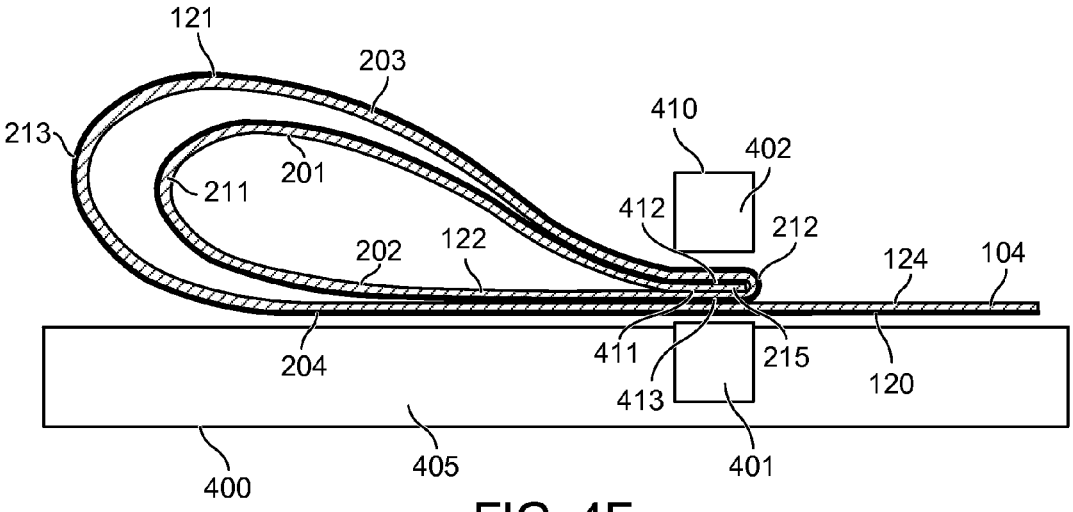

Next, as shown in FIG. 4E, the shade material 104 is folded over the rear surface 124 by bringing the second fold 212 up, towards, and over the rear surface 124 of the shade material 104, forming the fourth layer 204 connected to the third layer 203 by a third fold 213. This forms an outer pocket 121 comprising a third layer 203 connected to a fourth layer 204 via the third fold 213. The second fold 212 is pulled in direction 415 far enough such that the outer pocket 121 is formed larger than the inner pocket 122. As such, the outer pocket 121 is dimensioned larger than the inner pocket 122 and conceals the inner pocket 122 therein. Referring to FIG. 4F, the fourth layer 204 is fused to the first layer 201, the second layer 202, and the third layer 203 in proximity to the second fold 212 and over the first weld 411 and the second weld 412, creating a third weld 413. In some embodiments, the first weld 411, the second weld 412, and the third weld 413 are substantially aligned.

As is apparent, the manufacturing method of the present embodiments allows for the formation of a two-pocketed hem bar assembly 101 without having to flip over the shade material 104, which can be cumbersome and heavy. As such, the method of forming the two-pocketed hem bar assembly 101 can be easily and quickly executed by folding the shade material 104 and feeding it into the welding machine 400. Also, because the shade material 104 does not need to be continually flipped over during production, the shade material 104 is not continually manipulated, reducing the likelihood that it can be damaged during production.

FIG. 5 shows a side view of another embodiment of a hem bar assembly 500 comprising an inner pocket 522 enclosed within an outer pocket 521 formed from and integral with the shade material 505. The inner pocket 522 is formed from a first layer 501 connected to a second layer 502 at a first fold 511, forming an opening 526 therein. The inner pocket 522 is connected to an outer pocket 521 via a second fold 512. The outer pocket 521 is formed from a third layer 503 connected to a fourth layer 504 at a third fold 513, forming an opening 525 therein. The second layer 502 of the inner pocket 522 is connected to the third layer 503 of the outer pocket 521 via the second fold 512. The fourth layer 504 of the outer pocket 522 extends down from and coextensive with the shade portion 528 forming a smooth, uninterrupted, and continuous front surface 520. The layers 501, 502, 503, and 504 are secured to each other at their top ends 514, 515, 516, and 517, at the top end 518 of the hem bar assembly 500, via a seam 524, such as by heat welding, stitching, or the like. The terminal bottom end 519 of the shade material 505, which is part of the first layer 501, is secured between the top end 515 of the second layer 502 and the top end 517 of the fourth layer 504. The weighted bar 523 is positioned inside the inner pocket 522, which in turn is enveloped in the outer pocket 521. The space 525 formed between the inner pocket 522 and the outer pocket 521 allows the outer pocket 521 to be deflected once its bottom end 529 contacts a horizontal surface, while the inner pocket 522 is not altered. As a result, the weighted bar 523 continues to pull down on the shade portion 528 such that it continues to hang straight, without causing the shade portion 528 of the shade material 505 to buckle or to show ripples.

FIGS. 6A-6F illustrate the process of manufacturing the two-pocketed hem bar assembly 500. While the layers of the hem bar assembly 500 are shown to be fused together via heat welding using a heat welding machine 600, the layers of the hem bar assembly 500 can be secured via other means known to those skilled in the art, including, but not limited to stitching and adhesive. Additionally, the shade material 505 can comprise fabric, plastic, vinyl, or other materials known to those skilled in the art. To enable shade material 505 to be heat welded, shade material 505 can be made of a thermoplastic material, such as PVC, its surface can be coated a thermoplastic layer or adhesive, or thermoplastic films or strips can be added between the layers to be welded.

Figure 6A:
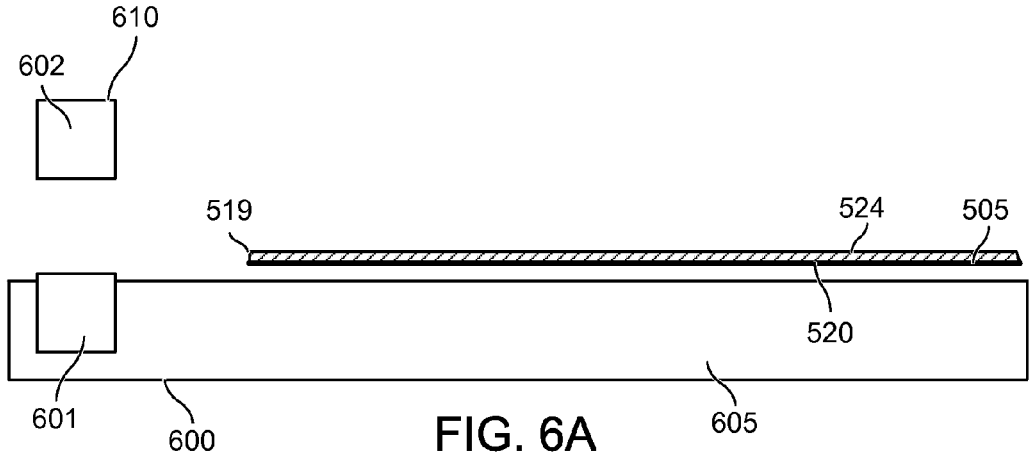
Figure 6B:
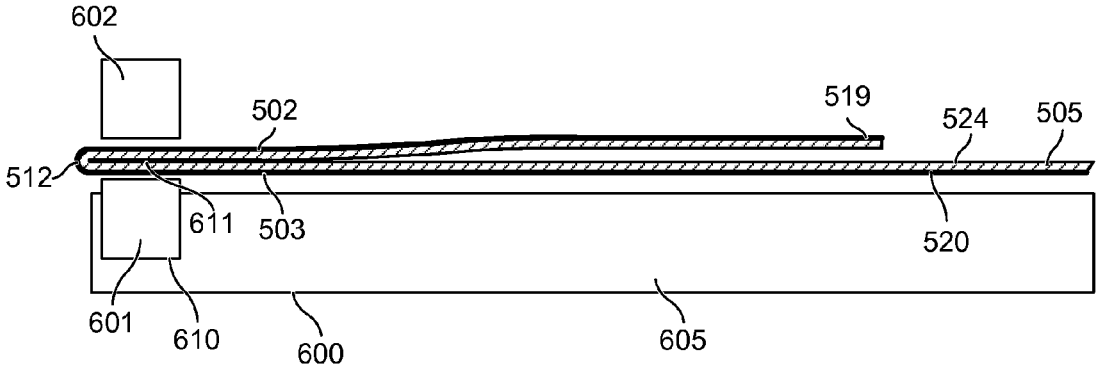

As shown in FIG. 6A, the shade material 505 is laid flat on the flat surface 605 of the welding machine 600. Shade material 505 is laid with its decorative front surface 520 faced down, the rear surface 524 faced up, and the terminal bottom end 519 facing the welding feeder assembly 610. As shown in FIG. 6B, the shade material 505 is then folded over the rear surface 524 (rear surface 524 to rear surface 524) by bringing the terminal bottom end 519 of the shade material 505 up, over, and towards the rear surface 524, forming the second layer 502 and the third layer 503 connected by the second fold 512. The shade material 505 can be folded manually or automatically via the welding machine 600 as is known in the art. Next, the second layer 502 and third layer 503 are fused together in proximity to the second fold 512 via heating strip 601 and the sealing strip 602 of the welding machine 600, creating a first weld 611.

Figure 6C:
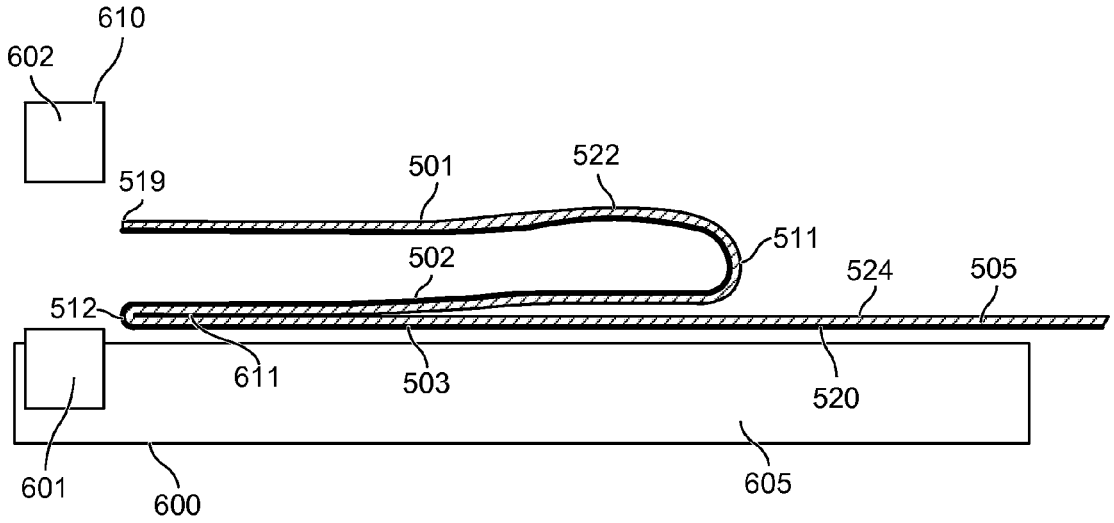
Figure 6D:
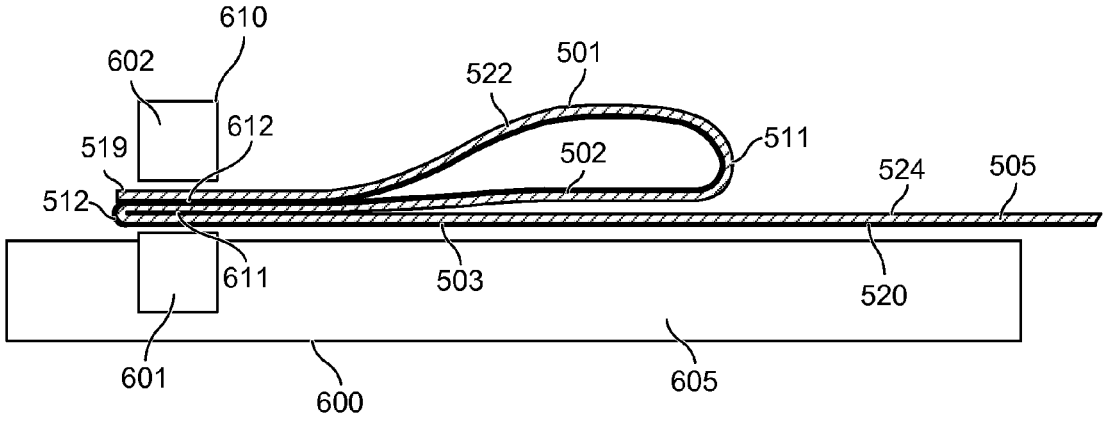

As shown in FIG. 6C, the shade material 505 is then folded over the front surface 520 by bringing the terminal bottom end 519 of the shade material 505 up, over, and towards the second fold 512, forming the first layer 501 connected to the second layer 502 by the first fold 511. This forms an inner pocket 522 comprising the first layer 501 connected to the second layer 502 via the first fold 511. As shown in FIG. 6D, the first layer 501 is fused to the second layer 502 and the third layer 503 in proximity to the second fold 512 and over the first weld 611, creating a second weld 612.

Figure 6E:
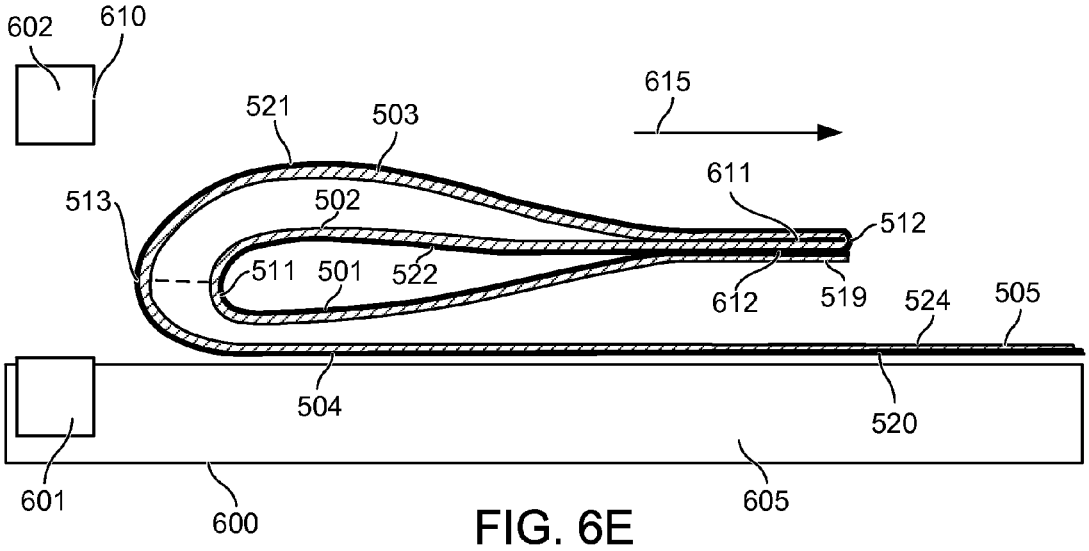
Figure 6F:
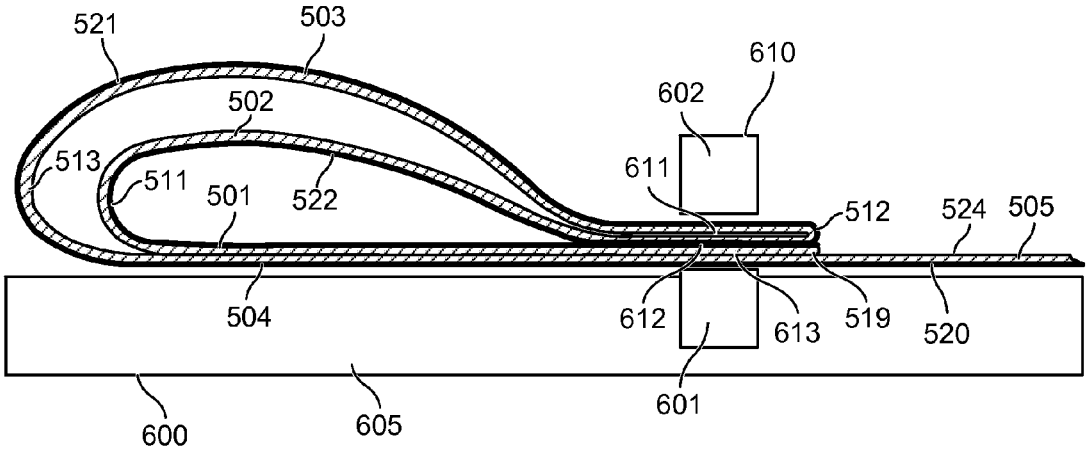

Next, as shown in FIG. 6E, the shade material 505 is folded over the rear surface 524 by bringing the second fold 512 towards, and over the rear surface 524 of the shade material 505, forming the fourth layer 504 connected to the third layer 503 by the third fold 513. This forms the outer pocket 521 comprising the third layer 503 connected to the fourth layer 504 via the third fold 513. The second fold 512 is pulled in direction 615 far enough such that the outer pocket 521 is formed larger than the inner pocket 522. Referring to FIG. 6F, the fourth layer 504 is fused to the first layer 501, the second layer 502, and the third layer 503 in proximity to the second fold 512 and over the first weld 611 and the second weld 612, creating a third weld 613. In some embodiments, the first weld 611, the second weld 612, and the third weld 613 are substantially aligned. Again, the above manufacturing method allows for the formation of a two-pocketed hem bar assembly 500 without having to flip over the shade material 505.

As described above, various manufacturing processes are discussed in reference to FIGS. 4A-4F and 6A-6F. The manufacturing processes are not meant to limit the aspects of the embodiments, or to suggest that the aspects of the embodiments should be implemented following the manufacturing process. The purpose of the foregoing manufacturing processes is to facilitate the understanding of one or more aspects of the embodiments and to provide the reader with one or many possible implementations of the processes discussed herein. The various steps performed during the foregoing manufacturing process are not intended to completely describe the manufacturing process but only to illustrate some of the aspects discussed above. It should be understood by one of ordinary skill in the art that the steps may be performed in a different order and that some steps may be eliminated or substituted. For example, one or more of the intermediate welding steps shown in FIGS. 4B, 4D, 6B, and 6D can be eliminated such that the layers of the two-pocketed hem bar assemblies 101 and 500 can be first formed by folding, and then fused as a final step.

INDUSTRIAL APPLICABILITY

To solve the aforementioned problems, the aspects of the embodiments are directed towards a roller shade having a hem bar assembly that absorbs the light gap created between the bottom of the shade material and a horizontal surface, such as a sill, without any additional hardware or changes in the appearance of the roller shade. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

All United States patents and applications, foreign patents, and publications discussed above are hereby incorporated herein by reference in their entireties.

Alternate Embodiments

Alternate embodiments may be devised without departing from the spirit or the scope of the different aspects of the embodiments. In various embodiments, the roller shade described herein may be used to cover a window, a door, a wall opening, or the like. In addition, the embodiments described herein may be adapted in other types of window or door coverings, such as inverted rollers, Roman shades, Austrian shades, pleated shades, blinds, shutters, skylight shades, garage doors, or the like.

The invention claimed is:

1. A method for manufacturing a hem bar assembly for a window treatment comprising an outer pocket enclosing an inner pocket constructed from a shade material, wherein the method comprises the steps of:

folding the shade material over a rear surface by bringing a bottom terminal end of the shade material up, over, and towards the rear surface, thereby forming the inner pocket comprising a first layer connected to a second layer by a first fold;

folding the shade material over its rear surface by bringing the first fold up, over, and towards the rear surface, thereby forming a third layer connected to the second layer by a second fold;

folding the shade material over its rear surface by bringing the second fold up, over, and towards the rear surface, thereby forming the outer pocket comprising the third layer connected to a fourth layer via a third fold; and securing the first layer, the second layer, the third layer, and the fourth layer to each other at their top ends proximal to the second fold such that the bottom terminal end of the shade material forms the top end of the first layer and is secured between the top end of the second layer and the top end of the third layer in proximity of the second fold.

2. The method of claim 1, wherein the shade material comprises a shade portion and the hem bar assembly, wherein the fourth layer extends down from and is coextensive with the shade portion forming a smooth, uninterrupted, and continuous front surface.

3. The method of claim 1, wherein the first layer, the second layer, the third layer, and the fourth layer are secured to each other at their top ends via at least one seam, heat welding, stitching, adhesive, a thermoplastic layer, a thermoplastic film or a strip, or any combinations thereof.

4. The method of claim 1, wherein securing the first layer, the second layer, the third layer, and the fourth layer to each other at their top ends comprises the steps of:

fusing the first layer and the second layer in proximity to the bottom terminal end, thereby forming a first weld;

fusing the third layer to the first layer and the second layer over the first weld, thereby forming a second weld; and fusing the fourth layer to the first layer, the second layer, and the third layer over the first weld and the second weld, thereby forming a third weld.

5. The method of claim 4, wherein the first, second, and third welds are formed by receiving the layers of the shade material between a heating strip and a sealing strip of a welding feeder assembly.

6. The method of claim 1, wherein, prior to folding, the method further comprises the step of:

laying the shade material flat with a decorative front surface faced down and its rear surface faced up.

7. The method of claim 6, wherein the folding steps are performed without flipping over the shade material.

8. The method of claim 1, wherein when the window treatment is in a closed position, a bottom end of the hem bar assembly contacts a horizontal surface and the outer pocket deflects and conforms to the horizontal surface to eliminate a gap between the hem bar assembly and the horizontal surface.

9. The method of claim 1, wherein when the window treatment is in a closed position, a bottom end of the outer pocket contacts a horizontal surface and a bottom end of the inner pocket is positioned at a distance above the bottom end of the outer pocket.

10. The method of claim 1, wherein the shade material comprises a shade portion and the hem bar assembly, wherein the inner pocket contains a weighted bar, and wherein when the shade is in a closed position the weighted bar hangs above a horizontal surface and pulls down on the shade portion such that it hangs straight, without causing the shade portion of the shade material to buckle or ripple.

11. The method of claim 1, wherein the hem bar assembly is integral with the shade material and is constructed by folding a bottom portion of the shade material.

12. The method of claim 1, wherein the first layer, the second layer, the third layer, the first fold, and the second fold are hidden from a front view of the shade.

13. A method for manufacturing a hem bar assembly for a window treatment comprising an outer pocket enclosing an inner pocket constructed from a shade material, wherein the method comprises the steps of:

folding the shade material over a rear surface by bringing a bottom terminal end of the shade material up, over, and towards the rear surface, thereby forming the inner pocket comprising a first layer connected to a second layer by a first fold;

fusing the first layer and the second layer in proximity to the bottom terminal end, thereby forming a first weld;

folding the shade material over its rear surface by bringing the first fold up, over, and towards the rear surface, thereby forming a third layer connected to the second layer by a second fold;

fusing the third layer to the first layer and the second layer over the first weld, thereby forming a second weld;

folding the shade material over its rear surface by bringing the second fold up, over, and towards the rear surface, thereby forming the outer pocket comprising the third layer connected to a fourth layer via a third fold; and fusing the fourth layer to the first layer, the second layer, and the third layer over the first weld and the second weld, thereby forming a third weld.

14. The method of claim 13, wherein, prior to folding, the method further comprises the step of:

laying the shade material flat with a decorative front surface faced down and its rear surface faced up.

15. The method of claim 13, wherein the bottom terminal end of the shade material forms the top end of the first layer and is secured between the top end of the second layer and the top end of the third layer in proximity of the second fold.

16. The method of claim 13, wherein the shade material comprises a shade portion and the hem bar assembly, wherein the fourth layer extends down from and is coextensive with the shade portion forming a smooth, uninterrupted, and continuous front surface.

17. The method of claim 13, wherein the first, second, and third welds are formed by receiving the first layer, second layer, third layer and fourth layer of the shade material between a heating strip and a sealing strip of a welding feeder assembly.

18. A method for manufacturing a hem bar assembly for a window treatment comprising an outer pocket enclosing an inner pocket constructed from a shade material, wherein the inner pocket comprises a first layer connected to a second layer by a first fold, the inner pocket connected to the outer pocket via a second fold, and the outer pocket comprises a third layer connected to a fourth layer via a third fold, method comprises the steps of:

folding the shade material over a rear surface by bringing a bottom terminal end of the shade material up, over, and towards the rear surface, thereby forming the second layer and the third layer connected by the second fold;

folding the shade material over a decorative front surface by bringing the bottom terminal end of the shade material up, over, and towards the second fold, thereby forming the inner pocket comprising the first layer connected to the second layer by the first fold;

folding the shade material over the rear surface by bringing the second fold up, over, and towards the rear surface of the shade material, thereby forming the outer pocket comprising the third layer connected to the fourth layer by the third fold;

securing the first layer, the second layer, the third layer, and the fourth layer to each other at their top ends proximal to the second fold such that the bottom terminal end of the shade material forms the top end of the first layer and is secured between the top end of the second layer and the top end of the fourth layer in proximity of the second fold.

19. The method of claim 18, wherein, prior to folding, the method further comprises the step of:

laying the shade material flat with its decorative front surface faced down and its rear surface faced up.

20. The method of claim 18, wherein securing the first layer, the second layer, the third layer, and the fourth layer to each other at their top ends comprises the steps of:

fusing the second layer and the third layer in proximity to the second fold, thereby forming a first weld;

fusing the first layer to the second layer and the third layer over the first weld, thereby forming a second weld; and fusing the fourth layer to the first layer, the second layer, and the third layer over the first weld and the second weld, thereby forming a third weld.

* * * * *